United States Patent [19]

Parramore

[11] Patent Number: 4,663,793

[45] **Date of Patent: * May 12, 1987**

[54] METHODS OF DEPLOYING A BRIDGE OF A PARTICULAR CONSTRUCTION

[75] Inventor: Thomas S. Parramore, Christchurch, England

[73] Assignee: Fairey Engineering Limited, Stockport, England

[ * ] Notice: The portion of the term of this patent subsequent to Jun. 11, 2002 has been disclaimed.

[21] Appl. No.: 742,663

[22] Filed: Jun. 7, 1985

Related U.S. Application Data

[63] Continuation-in-part of Ser. No. 447,550, Dec. 7, 1982, Pat. No. 4,521,932.

[30] Foreign Application Priority Data

Dec. 8, 1981 [GB] United Kingdom ..... 8137003
Jun. 14, 1984 [GB] United Kingdom ..... 8415135

[51] Int. Cl.[4] ..... E01D 15/12
[52] U.S. Cl. ..... 14/2.4
[58] Field of Search ..... 14/2.4, 2.6, 17, 73, 14/1; 414/339, 529

[56] References Cited

U.S. PATENT DOCUMENTS

| | | | |
|---|---|---|---|
| 3,504,389 | 4/1970 | Longbottom | 14/13 |
| 3,651,528 | 3/1972 | Behrmann et al. | 14/27 |
| 4,288,881 | 9/1981 | Mahncke et al. | 14/2.4 |
| 4,299,002 | 11/1981 | Wagner et al. | 14/2.4 |
| 4,521,932 | 6/1985 | Parramore | 14/2.4 |

FOREIGN PATENT DOCUMENTS

| | | | |
|---|---|---|---|
| 2116120 | 10/1972 | Fed. Rep. of Germany | 14/2.4 |
| 2530359 | 1/1977 | Fed. Rep. of Germany | 14/2.4 |
| 2477599 | 9/1981 | France | 14/2.4 |
| 2929208 | 2/1981 | German Democratic Rep. | 14/2.4 |
| 180327 | 8/1962 | Sweden | 14/2.4 |
| 2039311 | 8/1980 | United Kingdom | 14/2.4 |

*Primary Examiner*—Stephen J. Novosad
*Assistant Examiner*—Bruce M. Kisliuk
*Attorney, Agent, or Firm*—Millen & White

[57] ABSTRACT

A method of deploying a modular bridge across a span having a home bank and a far bank wherein a plurality of modular bridge sections are utilized includes providing a launching vehicle with a support for bridge launching. The method employs the steps of booming out a launching rail from the vehicle until the launching rail reaches the far bank and thereafter placing the modular bridge sections on the launching rail in order to form the bridge.

18 Claims; 38 Drawing Figures

METHODS OF DEPLOYING A BRIDGE OF A PARTICULAR CONSTRUCTION

RELATED PATENT APPLICATIONS

The instant application is a continuation-in-part of U.S. patent applicatin Ser. No. 447,550 filed Dec. 7, 1982, now U.S. Pat. No. 4,521,932.

BACKGROUND OF THE INVENTION

1. Field of the Invention

This invention relates to a method of constructing a modular bridge across a span and to a vehicle for use in such a method.

In military operations, it is desirable, if not essential, to have a capability for allowing heavy ground equipment, such as tanks, to cross difficulties in terrain. Such difficulties may include gaps formed by ditches, canals and rivers. Although the construction of a bridge for light vehicles is comparatively straightforward, providing a bridge which is capable of supporting a tank is of considerably greater difficulty.

2. Information Disclosure Statement

EP-A-No. 0081388 discloses a modular bridge comprising at least one intermediate bridge module and two end bridge modules, each of the bridge modules comprising two longitudinal main girder structures and an intermediate deck having a deck surface, the main girder structures being foldably connected one along each side of the deck and being foldable from an operative position in which the main girder structures offer extensions of the deck surface on either side of the deck for use to a closed position in which the main girder structures are folded beneath the deck, the main girder sturctures of the end bridge modules being longitudinally tapered in depth when seen from a side of the module in its operative position, the main girder structures of the intermediate module(s) not being so tapered, wherein each of the end bridge modules and the intermediate bridge module(s), are connected to form a bridge.

EP-A-No. 0081388 discloses the construction of such bridge by putting up a building frame, having upwardly facing rollers, on the first bank of the span to be crossed. A preliminary beam is assembled on the frame and pushed outwards towards the bank. The bridge aseembly is assembled progressively on the frame, behind the preliminary beam, with the beam being attached to the leading module. The preliminary beam has at its outer end a jacking unit with support rollers so that, when the jacking unit reaches the far bank of the span, it may rest on its and allow the assembly of beam and bridge to roll across the span, the bridge assembly is then lowered onto the bank and the beam withdrawn back through the bridge assembly. This procedure is illustrated in FIGS. 23A to 23F of EP-A-No. 0081388.

EP-A-No. 0075671 discloses a demountable non-opening bridge comprising discrete channel-section modules and an H-section launching girder, wherein modules comprise a central part and two wing parts, the wing parts comprise box-section track girders, the two wing parts are downwardly hinging below the central part for transportation, in the laying of the bridge the launching girders are assembled and made first, whereafter the various modules are coupled together and pushed over the launching girder and the launching girder remains in the bridge as a bearing element.

EP-A-No. 0075671 discloses the construction of such a bridge by the joint use of a laying vehicle having a cantilever arm and a four-tonne crane. The laying vehicle moves to the bank of the span to be crossed with a launching girder ramp (or end) member already in position on guide rollers of the cantilever arm. The cantilever arm comprises a pinion to advance the ramp member over the span by means of a cooperating rack. The crane delivers launching girder inner sections which are coupled up and advanced. Once the launching girder has reached the required length, a second launching girder ramp (end) member is coupled up. The cantilever arm of the laying vehicle is lowered so that the launching girder is then supported by its own hydraulically deployable feet. A ramp (end) bridge module is now lifted by the crane onto the launching girder. Inner (intermediate) bridge modules are coupled up and drawn over the launching girder by means of a block and tackle and reversing roller. The final module is a further ramp (end) module. The hydraulic feet are than retracted. This construction sequence is as illustrated in FIG. 6 of EP-A-No. 0075671.

EP-A-No. 0075671 also discloses the use of a single laying vehicle combining the capabilities of the laying vehicle and crane described above. It is equipped both with a cantilever arm and with a four-tonne crane.

The bridge construction procedures disclosed in EP-A-No. 0075671 involve the launching rail, once completed, being removed from the launching vehicle before any of the bridge modules are positioned on the launching rail. Since successive bridge modules will be coupled together on the launching rail in position over the span, it is not a particularly simple (or, therefore, quick) exercise to couple succesive modules together. It is to be appreciated that military modular bridges are to be capable of being built quickly, even at night, by few men.

BRIEF SUMMARY OF THE INVENTION

According to a first aspect of the present invention, there is provided a vehicle for launching a modular bridge, the vehicle comprising a frame deployable over the back of the vehicle, a support on the frame for a launching rail for the bridge, and means for supporting a bridge module.

With this construction, it is possible for bridge modules to be placed, for example by a crane, in position on the launching rail, while the launching rail is still supported by the vehicle. By such construction, successive bridge modules can be coupled together at the site of the vehicle itself, rather than over a span which the modular bridge is to cross.

DESCRIPTION OF THE PREFERRED EMBODIMENTS

In a preferred embodiment, the frame is slidably deployable over the back of the vehicle. The absence of any pivoting joints in such a construction ensures a strong structure, which can quickly be deployed. The frame may be suitably jacked down once deployed.

To achieve a greater distance between the centre of gravity of the vehicle and the jacking down point on the frame (which is advantageous for a reason that will be explained below), the frame may itself comprise a first sliding frame slidable with respect to the vehicle body. There may also be a second sliding frame slidable with respect to the first sliding frame. The advantage of having the jacking down point as far away from the back of the vehicle body as possible, is that it allows the vehicle body to function effectively as a counter weight for the launching rail during the construction of the bridge. All that is needed is that the moment of the launching rail (when fully boomed out) about the fulcrum at the jacking down point is less than the moment of the vehicle body about the fulcrum.

In a particularly preferred embodiment, the launching rail support is tiltable with respect to the frame. This is useful because, apart from the effect due to launching rail droop, the far end of the launching rail, when fully boomed out, will be more or less at the height of the launching rail support on the vehicle on the home bank of the span, which will of course be above the level of the home bank itself. The far end of the launching rail can be landed by tilting the tiltable support. This also applied when the far bank is lower than the home bank.

When the frame is provided as first and second sliding frames, it is preferred that the launching rail support be tiltably mounted on the second sliding frame.

The vehicle can comprise means for booming out the launching rail, so as to keep the number of other items of equipment required to a minimum. The booming out means may be mounted on the launching rail support and, in a particularly preferred embodiment, takes the form of a caterpillar-type friction drive under the launching rail.

The bridge module support means may comprise first bridge module support on the frame and a second bridge module support on the vehicle body. The first bridge module support is preferably provided at the jacking down point of the frame. The second bridge module support may take the form of one or more outriggers deployed from the vehicle body. The outriggers may be retractable by, for example, hydraulic piston and cylinder arrangements. Each of the first and second bridge module supports may be in two parts, each of which parts being suitable for supporting a main girder structure of a bridge module.

The vehicle can comprise means for launching bridge modules along the launching rail. The bridge module launching means may be mounted on the bridge module support means, particularly on the first bridge module support. The bridge module launching means may comprise one or more friction drives.

The vehicle may also comprise, preferably on the launching rail support, means for engaging with the launching rail. Thus, if the launching rail is of inverted-T shaped configuration, as is preferred, the engaging means can comprise a pair of hold-down rollers for bearing on the upper surfaces of the launching rail flanges, which result from the inverted-T shaped construction.

A vehicle in accordance with the first aspect of the invention may be used in a method according to a second aspect of the invention, according to which there is provided a method of constructing a modular bridge across a span, the method comprising deploying a frame over the back of the launching vehicle on the home bank of the span, placing a first bridge launching rail module on a support for the launching rail on the frame, booming out the launching rail as it is formed and placing subsequent launching rail modules on the launching rail support and coupling them to the launching rail being formed, landing the far end of the launching rail on the far bank of the span, placing a first bridge module on the launching rail and on bridge module support means on the vehicle, launching the bridge along the launching rail as the bridge is formed and placing subsequent bridge modules on the launching rail and on the bridge module support means and coupling them to the bridge being formed.

The frame may be deployed by sliding it over the back of the vehicle.

As indicated above, it is preferred that the frame comprises a first sliding frame slidable with respect to the vehicle body and a second sliding frame slidable with respect to the first sliding frame. When this preferred construction is provided, there is a particularly advantageous sequence of initial bridge construction steps which may be followed. First, the first sliding frame may be deployed by sliding it over the back of the vehicle, then the first and a second launching rail modules are coupled together on the launching rail support and then the second sliding frame is deployed by sliding it, on the first sliding frame, away from the vehicle. The first two launching rail modules are thus able to be connected quickly and conveniently.

Other preferred features of the method that relate to the use of the launching vehicle are as the corresponding preferred features of the first aspect of the invention, mutatis mutandis.

Although it is not essential for each of the bridge modules to be of any particular known construction, they will generally be of the type that comprises two longitudinal main girder structures and an intermediate deck having a deck surface.

Each bridge module is preferably substantially described in EP-A-No. 0081388 in that it comprises two longitudinal main girder structure and an intermediate deck having a deck surface, the main girder structures being foldably connected one along each side of the deck and being foldable between an operative position in which the main girder structures offer extension of the deck surface on either side of the deck for use and a closed position in which the main girder structures are folded beneath the deck.

A bridge formed on such modules will normally comprise two end modules, in each of which the main girder structures are longitudinally tapered in depth when seen from the side of the module and at least one intermediate module in which the main girder structures are not so tapered.

Some preferred features of modules suitable for use in the method of the present invention are the same as or closely similar to the preferred features of the modules disclosed in EP-A-No. 0081388. Thus, it is desirable that the main girder structures be box girder structures; that each main girder structure comprise at least one lifting attachment on a surface offering the extension of the deck surface; that each of the lifting attachments be recessed; that each main girder structure comprise at least one lifting attachment on a surface which is facing a corresponding surface of the other main girder structure when the module is in the operative position; that the deck comprise two lip portions and that each of the main girder structures comprise a shoulder portion, each of which lip portions stays on a respective one of the shoulder portions when the module is in the operative position; and/or that the module further comprise a bracing means between the main girder structure for bracing the module when in the operative position.

In EP-A-No. 0081388, the disclosed bracing means comprised steel bracing wires. In a preferred module suitable for use in the present invention, the bridge modules preferably comprise bracing arms, one end of each of which is pivotably attached either to a main girder structure or to the deck surface, and the other end of which is receivable in a slide in the other of the main girder structure and the deck. Preferably, the bracing arm is pivotably attached to the main girder structure and receivable in a slide in the deck.

A further preferred feature of a bridge module usable in the present invention concerns means for joining adjacent bridge modules. In EP-A-No. 0081388, joining plates are provided at each end of each of the intermediate bridge modules and at the inner end of each of the end modules. Each joining plate would be provided with a hole to receive a pin when joining plates of adjacent bridge modules are placed together. So much is similar with the present case. In the prior disclosure, however, pairs of joining plates would be provided at one end of the bridge module and would be adapted to lie either side of single joining plates of adjacent bridge modules. A pin would be manually inserted through the resulting laminate of joining plates to hold the modules together. In the present case, there are two improvements to this structure. First, the arrangement of joining plate is hermaphrodite in nature. It therefore does not matter which way round the intermediate bridge modules are. Secondly, means may be provided for remotely inserting a pin through a laminate of joining plates, each of which is provided with a pin-receiving hole. Such means may take the form of a bell-crank lever, adapted to be operable from the side of a bridge module when in position on the launching rail and arranged to move a pin through a laminate of joining plates. By this arrangement, it is not necessary for a man to go underneath the bridge during construction, thereby saving time.

A preferred feature of the method of the invention involves the use of means for altering the angle of approach offered by one or both of the end bridge modules. Such means may take the form of a hydraulically operable articulating ram for moving a tapered portion of the end bridge module with respect to a connecting portion of the module, which is adapted to connect to the end module to an adjacent intermediate module. One or more filling elements may be inserted in the end module so that the hydraulic cylinders can be relaxed after articulation.

It is particularly appropriate for further module bracing means, in addition to or instead of those described previously, to be provided. To this end, each bridge, comprising a number of modules, may be provided with a sub-frame or bracing frame for (a) bracing the bridge in the open position and (b) supporting the bridge on the launching rail so that it can be boomed out across the span. A sub-frame may be provided at each end of a bridge, preferably being located at the inner end of each of the end modules. Each sub-frame preferably has a pair of rollers, one for bearing on each flange of the inverted T-section of the launching rail.

BRIEF DESCRIPTION OF THE DRAWINGS

For a better understanding of the present invention, and to show how it may be put into effect, reference will now be made by way of example to the accompanying drawings, in which:

FIG. 11 is a part-schematic, part-sectional view taken along the line A—A of FIG. 10;

FIG. 12 shows a detailed (part elevational, part-sectional) view on arrow B in FIG. 10;

DETAILED DESCRIPTION OF THE INVENTION

Figure 1A:
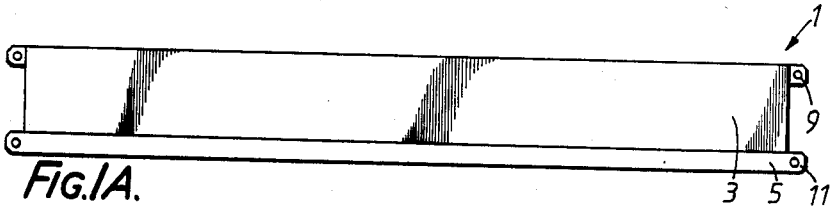
FIGS 1A, 1B and 1C show side elevation, plan and end views of an intermediate launching rail module.
Figure 1B:
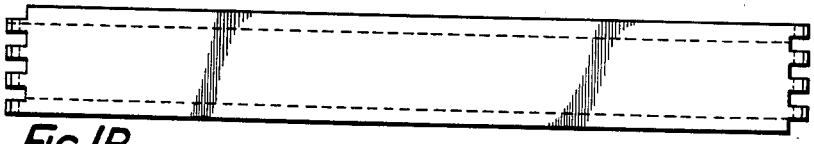
Figure 1C:
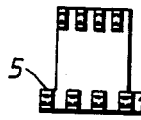

Referring now to the drawings, FIGS 1A to 1C and FIGS. 2A to 2C show the modules from which the launching rail used in the invention is built up. FIGS. 1A, 1B and 1C show an intermediate launching rail 1, which is of a length of 19 feet 6 inches (5.94 meters) which ensures that the launching rail modules are compatible for transport with the ISO 6.1 meters (20 feet) container system. Each intermediate launching rail module weighs about 0.8 tonnes and comprises a longitudinal upstanding member 3 which carries, at its lower edge, a pair of flanges 5 and 7. The intermediate launching rail module thus has the configuration of an inverted-T. Each is provided with a tension connection for connection to a bridge module, as will be described later.

At the upper and lower edges of each end of each intermediate launching rail module 1 is a row of joining lugs for connecting the module with an adjacent module. The upper row of lugs is designated by reference numeral 9 and the lower row by reference numeral 11. The joining lugs are so positioned that each intermediate launching rail module 1 is hermaphrodite in nature and can therefore connect with any other module. Horizontal pins (not shown) can be inserted through aligned holes in cooperating rows of joining lugs in adjacent launching rail modules.

Figure 2A:
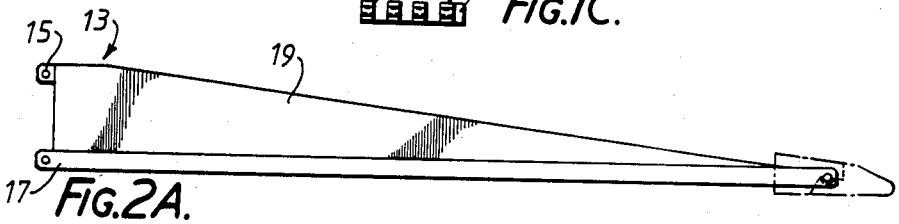
FIGS. 2A, 2B and 2C show side elevation, plan and end views of an end launching rail module.
Figure 2B:
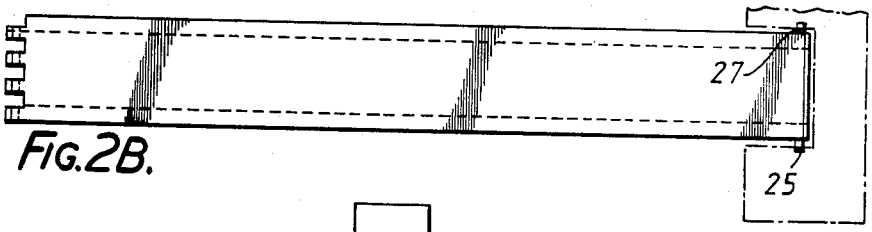
Figure 2C:
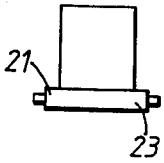
Figure 3A:
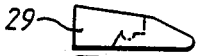
FIGS. 3A, 3B and 3C show side elevation, plan and end views of a bearing pad for use conjunction with an end module of a launching rail.
Figure 3B:
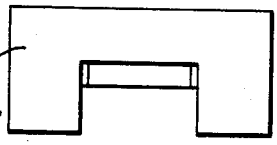
Figure 3C:
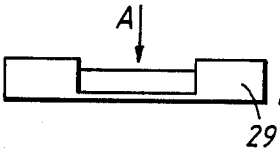

An end launching rail module 13 is shown in FIGS. 2A, 2B and 2C. The left-hand end of the module in FIGS. 2A and 2B is equipped with upper and lower rows of joining lugs 15 and 17, corresponding to the rows of joining lugs 9 and 11 described above for the intermediate launching rail module 1. The end launching rail module 13 comprises a tapered (when viewed from the side) longitudinal member 19 in the place of the longitudinal member 3 described for the intermediate launching rail module 1. The end launching rail module 13 also has lower flanges 21 and 23 and, in this respect, is also of a generally inverted-T shaped section. The right-hand end of the end launching rail module 13 shown in FIGS. 2A and 2B is equipped with opposed horizontally projecting studs 25 and 27 on opposite sides of the module. One use of the studs 25 and 27 is to engage with a bearing pad 29, shown in FIGS. 3A, 3B and 3C. The bearing pad 29 is shown in outline in FIGS. 2A and 2B. The purpose of the bearing pad 29 is to distribute the load of a bridge, when formed on the launching rail, on the bank of a span. There will be one bearing pad 29 at each end of the bridge. The pads 29 conform to the profile of the toe of the bridge and therefore present their upper surfaces as part of the bridge decking in use.

Each of the launching rail modules is of a lightweight hollow construction of rectangular section. The depth and width of each module is such that it can be accommodated beneath a bridge formed from bridge modules, which will now be described.

Figure 4A:
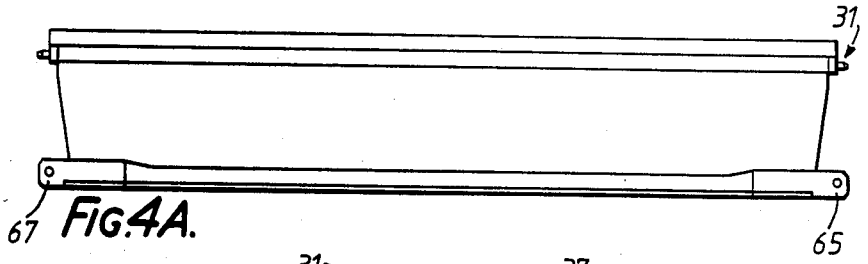
FIGS. 4A, 4B and 4C show side elevation, plan and end views of an intermediate bridge module in its open position.
Figure 4B:
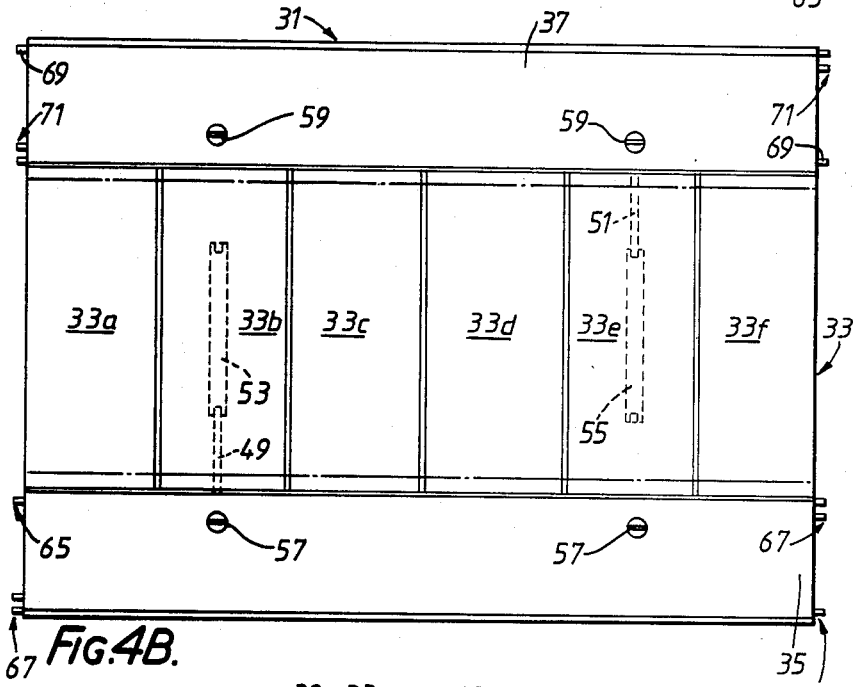
Figure 4C:
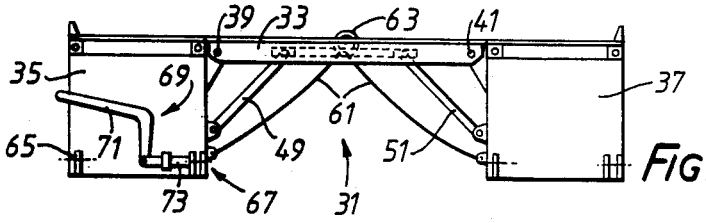
Figure 4D:
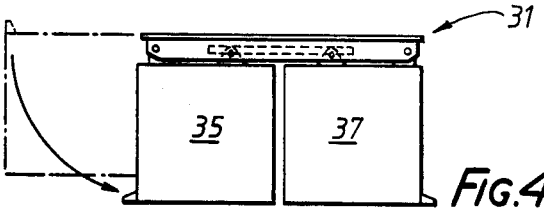
FIGS. 4D shows an end view of the module in its folded position.

As can be seen from FIGS. 4A, 4B and 4C, which illustrate an intermediate bridge module 31 in its open state, the modules envisaged for use in the present invention are substantially the same as those disclosed in EP-A-No. 0081388, the disclosure of which is incorporated by reference into this application. Each intermediate bridge module 31 comprises a centre decking 33 and left and right main girder structures 35 and 37 which can pivot about a respective axis 39 or 41 (FIG. 4C) to adopt the folded configuration shown in FIG. 4D for the purposes of transport.

Figure 4E:
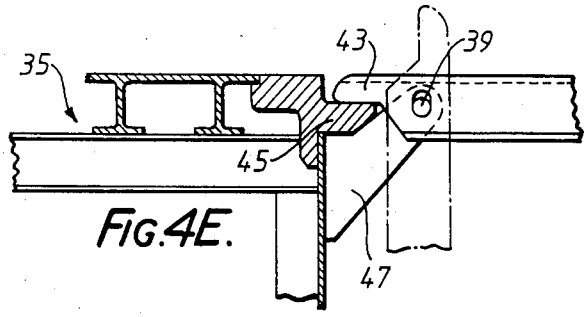
FIGS. 4E shows a detail of construction of the intermediate bridge module.

The decking 33 for each intermediate module 31 is formed of six generally planar decking members 33*a* to 33*f* (FIG. 4B), each side of which has a lip 43 (FIG. 4E) which, in the open position of the module, bears on a shoulder 45 of the adjacent main girder structure 35. A support arm 47 extending from the main girder section 35 bears the pivotal connection between the decking 33 and the main girder structure 35.

Pivotally mounted on each of the main girder structures 35 and 37 is a respective bracing arm 49 or 51, whose free end engages in a respective slide 53 or 55 (FIGS. 4B) at the underneath of the centre deck 33. The bracing arms 49 and 51 move in their respective slides 53 and 55 during folding and unfolding of the intermediate bridge modules 31.

Recessed lifting points 57 and 59 are provided in each main girder structure. When it is desired to unfold a bridge module from its folded (transport) position shown in FIG. 4D to its deployed, open position shown in FIGS. 4A, 4B and 4C, the module is simply lifted by means of a crane using a sling attached at the lifting points 57 and 59. The main girder structures 35 and 37 will swing of their own accord out from under the deck 33. The unfolding of the intermediate bridge modules is described in detail in EP-A-No. 0081388 and will not be repeated here, but it should be noted that the length of the sling can be chosen so that the line of action passes almost through the centre of gravity of the cross section of the intermediate bridge modules as they are unfolded. In this way, the load on the sliding bracing arms 49 and 51 and their stops which are mounted in slides 53 and 55 is minimised. Shock absorbers can additionally be fitted to reduce shock load.

As can be seen in FIG. 4C the intermediate bridge modules 31 is provided with a recovery sling 61, which comprises wires each attached to a lower portion of a surface of a respective one of the main girder structure 35 and 37 which is inwardly facing when the module is open, the wires terminating in a common ring 63, which is accessible from above the centre deck. To close the intermediate module 31, the module is simply picked up by a crane acting at the ring 63. Of its own accord, the module will fold to the position shown in FIG. 4D. Again, the general principle of the folding process is described in EP-A-No. 0081388 and will not be repeated here.

As for the dimensions of the intermediate bridge module, it is again 19 feet 6 inches in length (5.94 meters) to be compatible with the ISO 6.1 meter (20 feet) container system. When the module is in its folded condition, it is 8 feet (2.44 meters) in width, again to be compatible with the ISO container requirements, but in its open position the total width of the intermediate bridge module 31 is 13 feet 5 inches (4.1 meters), which is a sufficient width for carrying such heavy vehicle as tanks. Each of the main girder structures 35 and 37, over which the tracks of the tanks pass,is 40.5 inches (1.03 meters) in height (in the open position) and 39 inches (1 meter) in width (again in the open position).

Successive bridge modules are coupled together by means of nesting hermaphrodite joining plates 65, 67, 69 and 71, through holes in which a pin can be inserted. The nests of joining plates are arranged to be at the corners of the main girder structures 35 and 37. It will be appreciated that the most difficult nest for a pin to be passed through is the lower, inner nest, at which the joining plates 67 are located in FIGS. 4C. To obviate the need for a man to climb under the bridge during construction, a remote pin shooting apparatus 69 is provided. The pin shooting apparatus comprises a bell-crank lever 71, one end of which projects for the operator's use at the outer edge of the main girder structure 35, and the other end of which connects with a pin 73 to push the pin through a nest of joining plates 67 (and 65 of the next module). Pins through upper joining dowels can be inserted by a man on the deck 33 of the bridge module 31.

The tapered end bridge module 75 shown in FIGS. 5A to 5D has many features in common with the intermediate bridge module 31, but differs in that the main girder structures 77 and 79 are tapered when seen from the side, when the module is in its open (deployed) position. The end module 75 again comprises a deck 81, but this time only five deck members 81*a* to 81*e* are provided. The deck member at the fully tapered end of the end module 75 (the right-hand in FIGS. 5A and 5B) is missing: its place is taken in the fully assembed bridge by the bearing pad 29. The deck section 81*e* nearest the fully tapered end is provided with a connection 83 for connecting the module to the launching rail, as will subsequently be described.

Figure 5A:
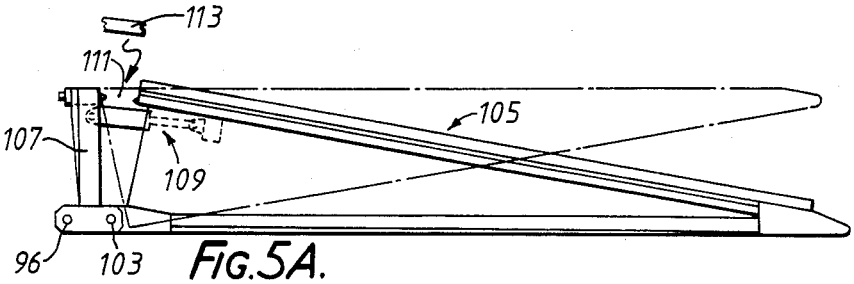
FIGS. 5A, 5B and 5C show side elevation, plan and end views of an end bridge module in its open position.
Figure 5B:
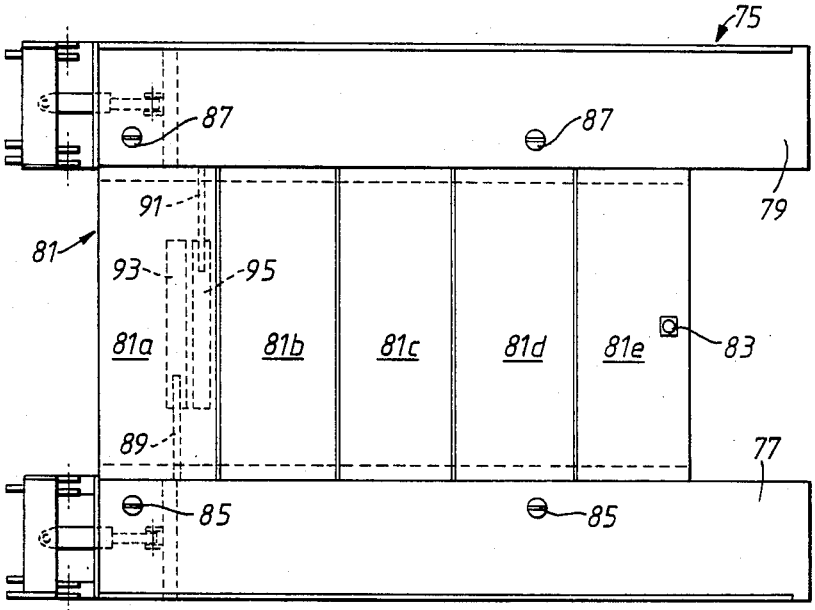
Figure 5C:
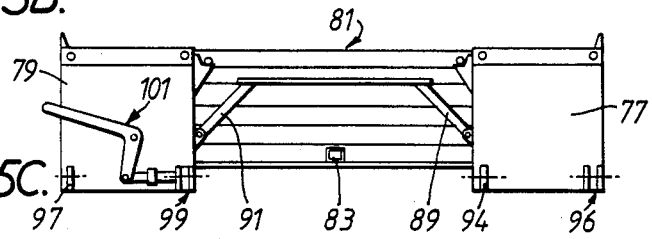
Figure 5D:
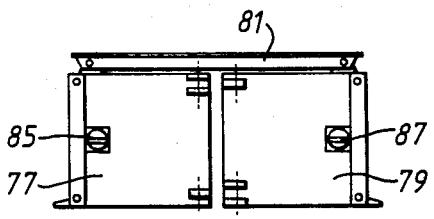
FIG. 5D shows an end view of such module in its folded position.
Figure 5E:
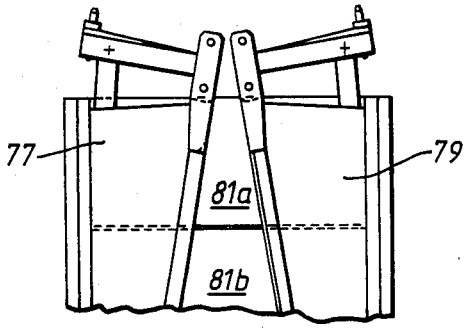
FIG. 5E shows a partial underneath view of a folded end module.

As with the intermediate bridge module 31, the end bridge module 75 can be opened from a closed position (shown in FIGS. 5D and 5E) to an open position (shown in FIGS. 5A, 5B and 5C) by lifting the end module 75 at recessed lifting points 85 and 87 on the deck-extension surfaces of the main girder structures 77 and 79 by means of a crane. A recovery sling (not shown) for the reverse operation is also provided. Opening and closing the end modules 75 is again very similar to the process described in EP-A-No. 0081388 and will not be repeated here.

Bracing arms 89 and 91 each attached to a respective main girder structure (77 or 79) by a pivot extend towards and terminate in slides 93 and 95 under the lower surface of the deck 81. Their purpose is the same as for the intermediate bridge module 31. Joining plates 94, 96, 97 and 99 are also correspondingly positioned for joining the end bridge modules 75 to its adjacent intermediate bridge module 31. A pin shooting mechanism 101 is again provided.

A difference between the end bridge module 75 and the intermediate bridge module 31 is that the end bridge module 75 is articulated by way of a pivot 103 at a lower portion of the end bridge module adjacent where it is connected to an intermediate bridge module 31. The articulation means that the end bridge module is split into a ramp section 105 and a joining section 107. The ramp section 105 can be moved relative to the joining section 107 by means of a hydraulic piston and cylinder arrangement 109 mounted at the joining end of each main girder structure 77 and 79. At one extent of the articulation (used when the bridge is being assembled on the launching rail and boomed out across the span it is to bridge) the upper surface of the deck 81 is level. This is shown by the discontinuous lines in FIG. 5A. At the other extent of the articulation, the lower surfaces of the main girder structures 77 and 79 are level. This is usually, though not exclusively, the position adopted when the bridge is in use for carrying traffic. This configuration is shown in solid lines in FIG. 5A. In such a configuration, there will be a gap 111 above the point of articulation at the pin 103. The gap 111 can be filled in use by a deck compression unit 113, which is a planar narrow deck extension unit. Hydraulic pressure in the piston and cylinder arrangement 109 can be relaxed once the deck compression unit is in place.

The maximum overall dimensions for the end bridge module 75 are the same as for the intermediate bridge module 31.

Figure 6A:
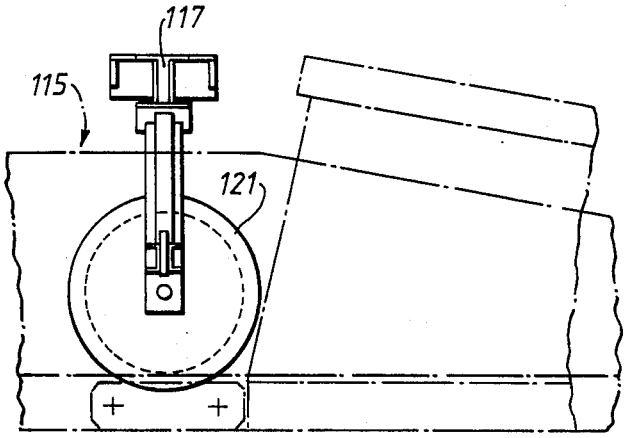
FIGS. 6A, 6B and 6C show side elevation, plan and end views of a sub-frame for bracing a bridge and for supporting bridge modules on a launching rail.
Figure 6B:
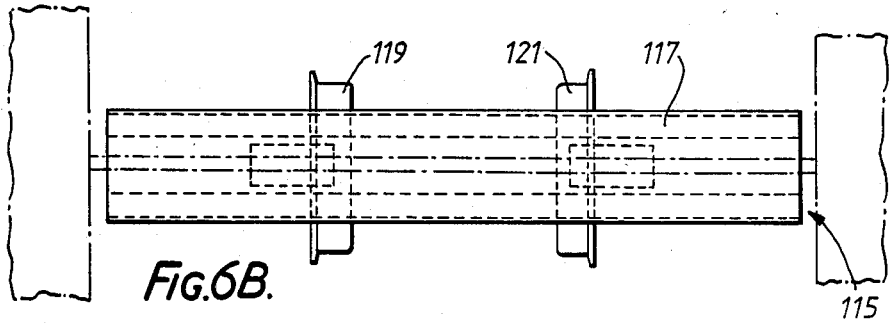
Figure 6C:
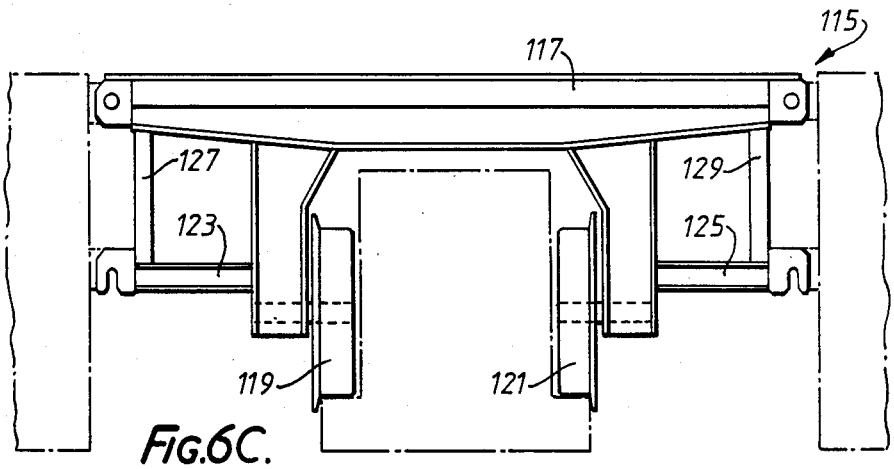

FIGS. 6A, 6B and 6C show an inter-trackway bracing frame. One of these is located under the deck at each end of the bridge formed from end and intermediate bridge modules 75 and 31 and allows the bridge to be supported on a launching rail, formed from launching rail end and intermediate modules 13 and 1, during booming out.

The bracing frame 115 also braces the bridge in the open position. Each bracing frame 115 is fitted to one of the end bridge modules 75 and is located in the jaws at the joining section 107 of each end bridge module 75. The bracing frame 115 consists of a portal frame 117, on the inside of each upright of which is mounted a flanged wheel 119 or 121 on a horizontal axis for supporting the bridge on flanges of the launching rail (shown in dotted lines in FIG. 6C). Additional supports 123 and 125 extend outwardly from the uprights to make further engagement with the end bridge module 75. Additional vertical bracing 127 and 129 extends between the supports 123 and 125 on the one hand and the cross member of the portal frame 117 on the other hand.

FIGS. 7A to 7E give an overall view of a bridge 131 after construction. The bridge comprises three intermediate bridge modules 31 and two end bridge modules 75. These can clearly be seen in the side and plan views of FIGS. 7A and 7B. Underneath the deck of the bridge 131 can be seen (in dotted lines in FIG. 7B) a launching rail 133, which is itself formed of intermediate modules 1 and end modules 13. A bracing frame 115 can be seen in position in FIG. 7D.

Figures 7A, 7B, 7C, 7D, 7E:
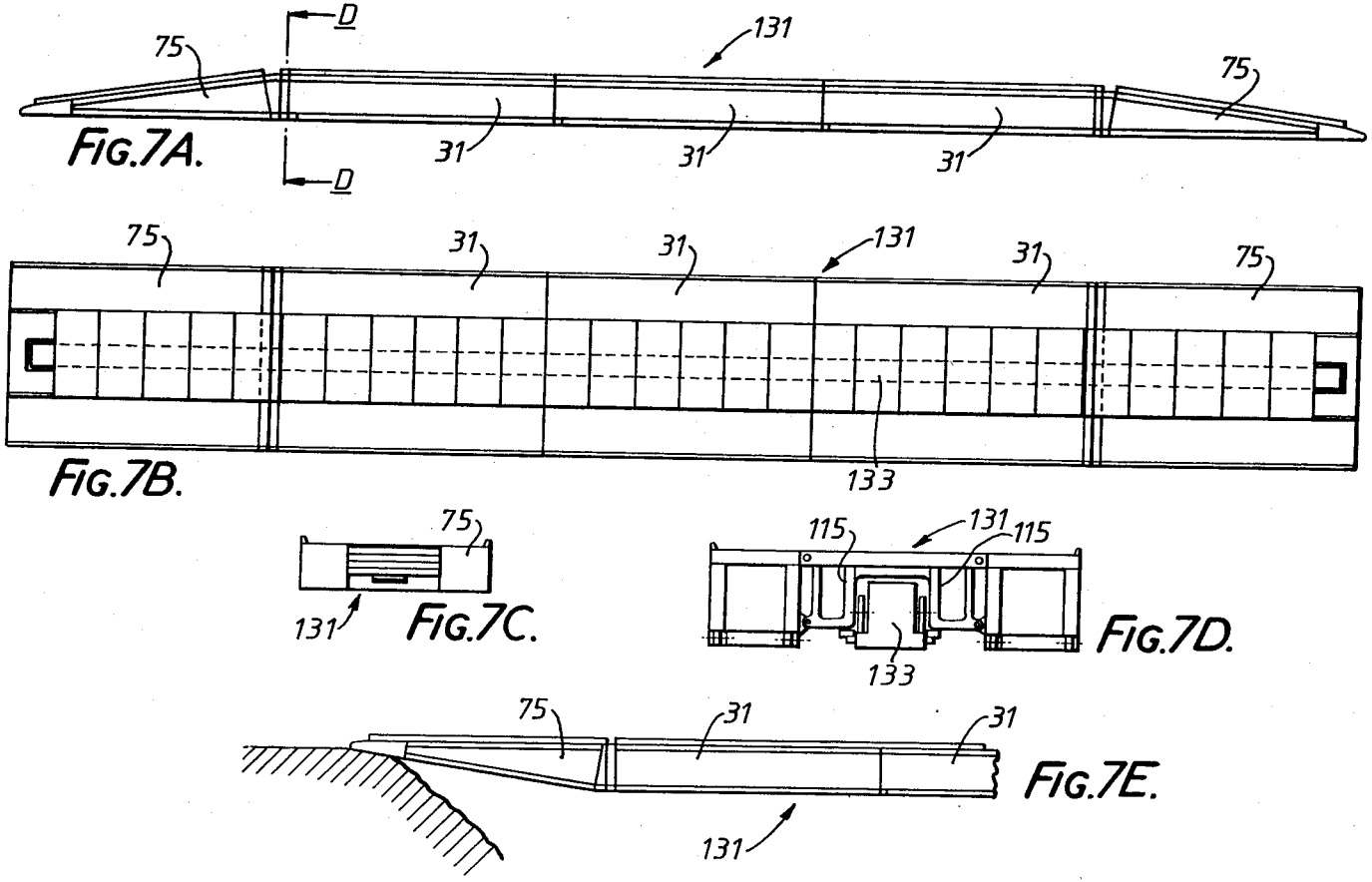
FIGS. 7A, 7B and 7C show side elevation, plan and end views of an assembled bridge.
FIG. 7D shows an enlarged section on D—D of FIG. 7A.
FIG. 7E shows a side elevation view of an alternative configuration of the end of a bridge.

FIGS. 7A and 7B show how the bridge 131 would be configured when spanning a gap between substantially level banks. Both bridge end modules are fully articulated. On the other hand, in FIG. 7E, the end module 75 is not articulated. This reduces the ramp slope at the end of the bridge and renders it more suitable for use on a sloping bank.

Figure 8A:
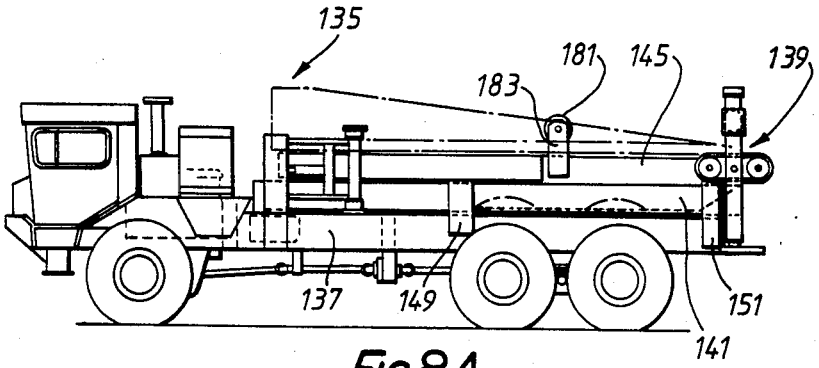
FIGS. 8A and 8B show side and back end elevational views of a bridge launching vehicle in accordance with the invention.
Figure 8B:
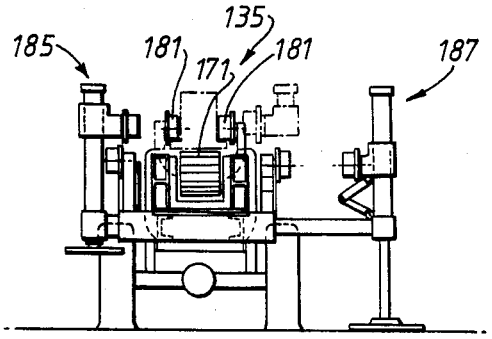

FIGS. 8A and 8B show a launching vehicle 135 in accordance with the invention. The vehicle 135 is based on the LP6 chassis (6×6 MMLC). The chassis is designated by the reference numeral 137 in FIG. 8A.

Figure 9A:
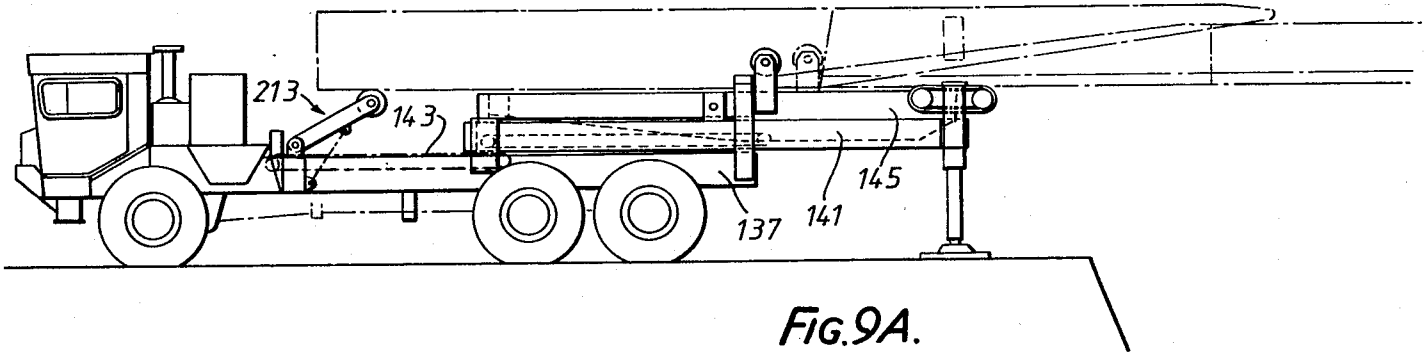
FIGS. 9A and 9B are side elevation views of the vehicle showing successive stages in the deployment of the frame.
Figure 9B:
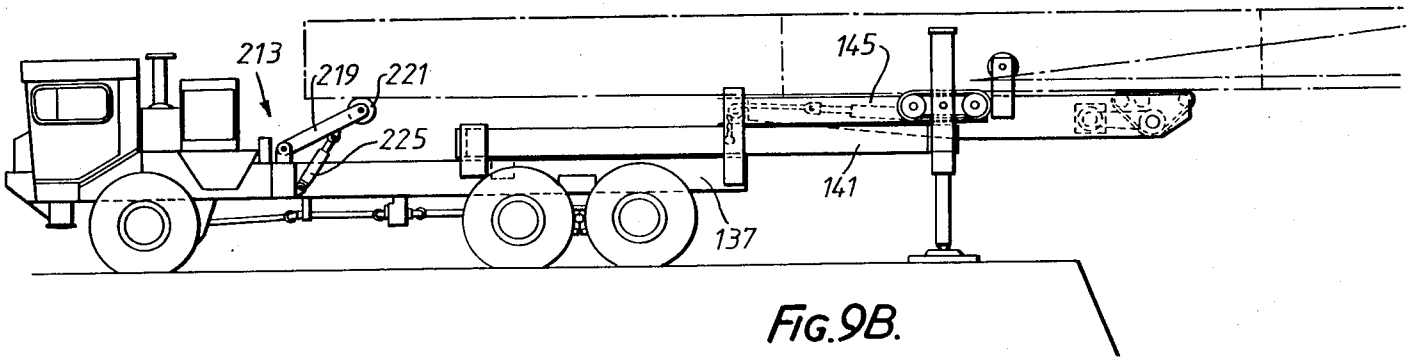
Figure 10:
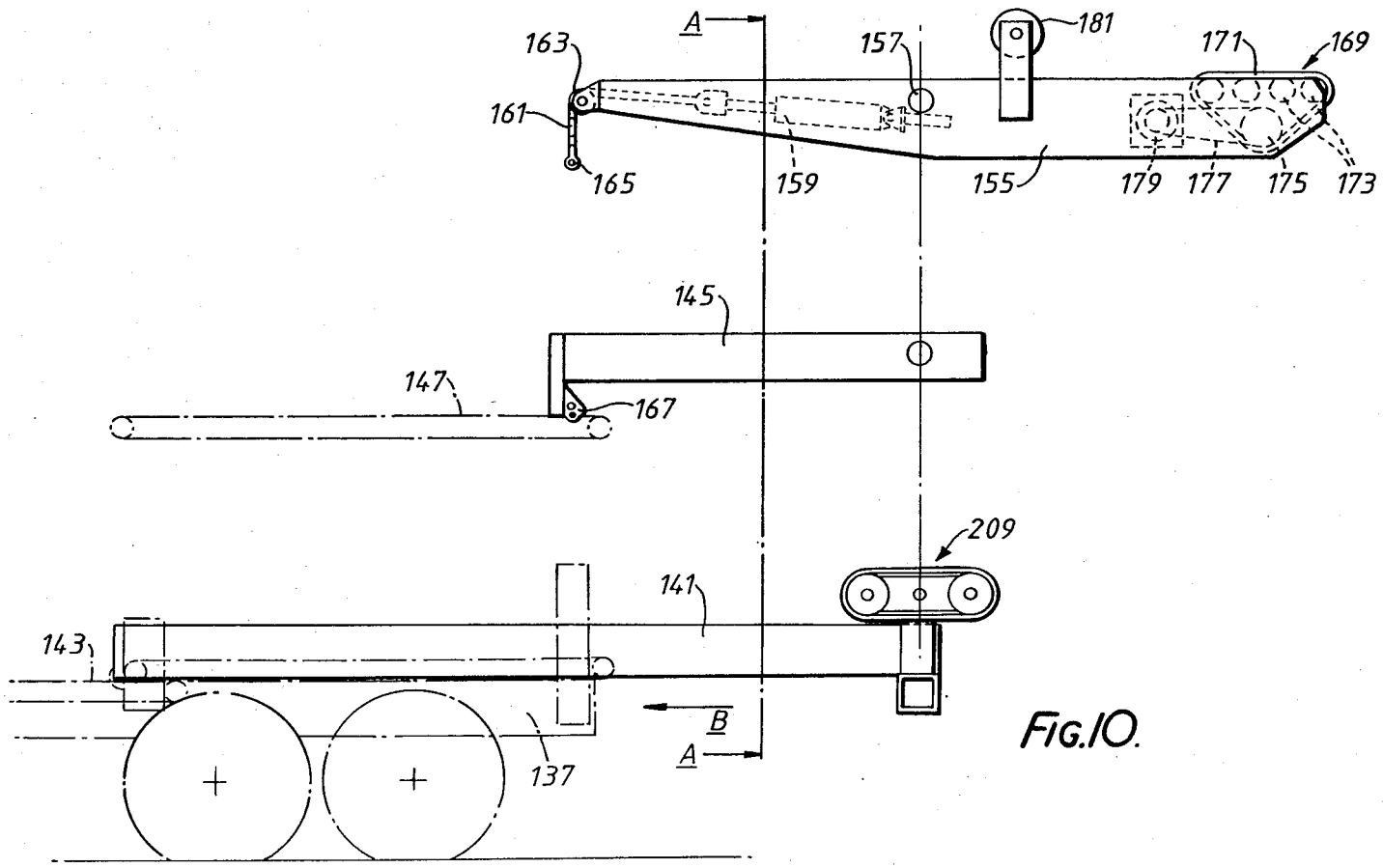
FIG. 10 is an exploded side elevational view showing the various components of the frame.

Mounted on the chassis 137, above the two rear axles for transit, is a frame 139. More detailed views of components of the frame 139 can be seen in FIGS. 10, 11 and 12. The frame 139 comprises a first sliding frame 141, which is slidably deployable over the back of the vehicle by means of a first end5. less roller chain 143, which is powered by a hydraulic motor (not shown). The first sliding frame 141 can be driven from a position shown in FIG. 8A to a position shown in FIG. 9A by means of the first endless roller chain 143.

Slidably mounted above the first sliding frame 141 is a second sliding frame 145. Like the first sliding frame 141, the second sliding frame 145 is generally in the form of a beam. It can be slidably deployed along the first sliding frame 141 by means of a second endless roller chain 147, which is again driven by a hydraulic motor (not shown).

Mounted on the chassis 137 are two hold-down brackets 149 and 151. The first hold-down bracket embraces the first sliding frame 141 and keeps it adjacent the chassis 137. The second hold-down bracket is shown in detail in FIG. 12 and comprises upper and lower sleeve portions separated by a pair of anti-friction pads 153. The lower sleeve again embraces the first sliding frame 141 and the upper sleeve embraces the second sliding frame 145. The first hold-down bracket is mounted just to the front of the forward-most of the two rear axles of the vehicle, whereas the second hold-down bracket is mounted at the very back of the chassis.

Pivotally mounted on the second sliding frame 145 is a support 155 for the launching rail. The support 155 can tilt about an axis 157 with respect to the second sliding frame. Tilting is achieved by means of the hydraulic piston and cylinder arrangement 159, the cylinder of which is fixed to the support 155 and the piston of which is coupled to a chain and link mechanism 161, which passes over a bearing 163 at the vehicular front of the support 155 to terminate in an attachment 165 for attaching to a pin 167 at the vehicular front end of the second sliding frame 145.

At the vehicular rear of the support 155, there is provided at the upper surface of the support 155 a caterpillar-type friction drive 169 for driving the launching rail when supported on the support 155. The caterpillar-type friction drive 169 comprises an endless belt 171, which passes over a plurality of support rollers 173 and under a lower drive roller 175. The drive roller 175 is itself coupled by an endless belt 177 to a hydraulic motor 179.

Figure 10X:
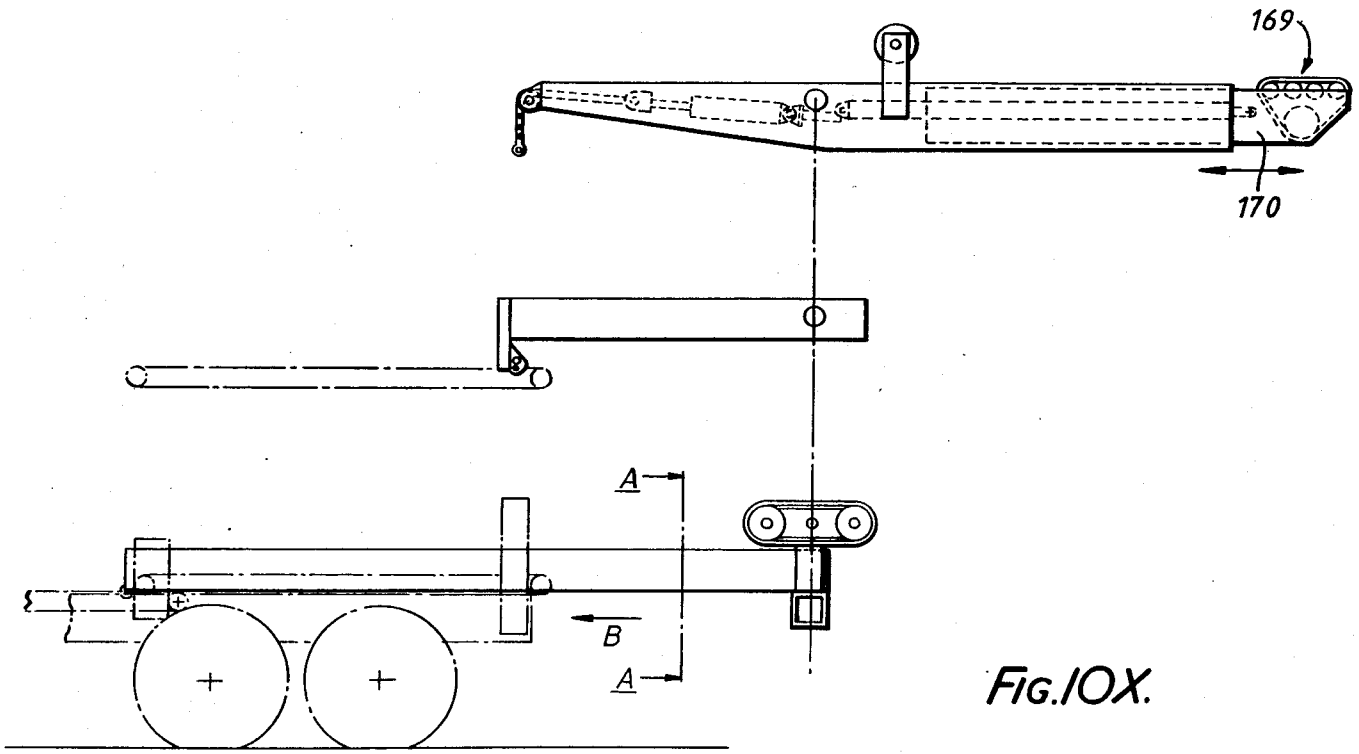
FIG. 10X is similar to FIG. 10 but shows an alternative embodiment of the frame.

The friction drive 169 may be mounted on a telescopic arm 170 which extends from the support 155. This alternative embodiment, which is shown in FIG. 10X, allows the launching rail to be supported at its maximum depth, thereby obviating the maximum cantilever bending moment occurring at a reduced reaction on the tapered end launching rail module 13.

To engage with the upper surfaces of the flanges of the inverted-T shaped launching rail, a pair of hold-down rollers 181, which are themselves flanged, are provided. The hold-down rollers are mounted on arms 183, which extend upwardly, one either side of the support 155.

The launching vehicle comprises means for supporting a bridge module. Part of the bridge module support means is constituted by a pair of frame outriggers 185 and 187, which can extend laterally and telescopically from under the first sliding frame 141. The outermost end of each frame outrigger 185 or 187 is provided with a jacking hydraulic piston and cylinder arrangement 189 and 191 respectively, the downwardly extending pistons of which terminate in respective ground pads 193 and 195. Slidably movable up the cylinder of each of the hydraulic and piston and cylinder arrangements 189 and 191 is a respective roller support collar 197 or 199. Movement of each collar 197 or 199 up and down the respective cylinder is accomplished by means of articulated arms 201 or 203 respectively. Each collar 197 or 199 carries an inwardly directed roller 205 or 207, which will support the outermost edges of the main girder structures of the bridge modules. The rollers 205 and 207 are not powered, but are mounted opposite and cooperate with respective bridge module friction drives 209 and 211 which support the inner edges of the main girder structures of the bridge modules and cause them to be driven forward when launching the bridge along the launching rail. As can be seen from FIGS. 10, 11 and 13, the bridge modules friction drives 209 and 211 each comprise an endless belt mounted on two rollers fixed to an arm extending upwardly from the first sliding frame 141.

Figure 13:
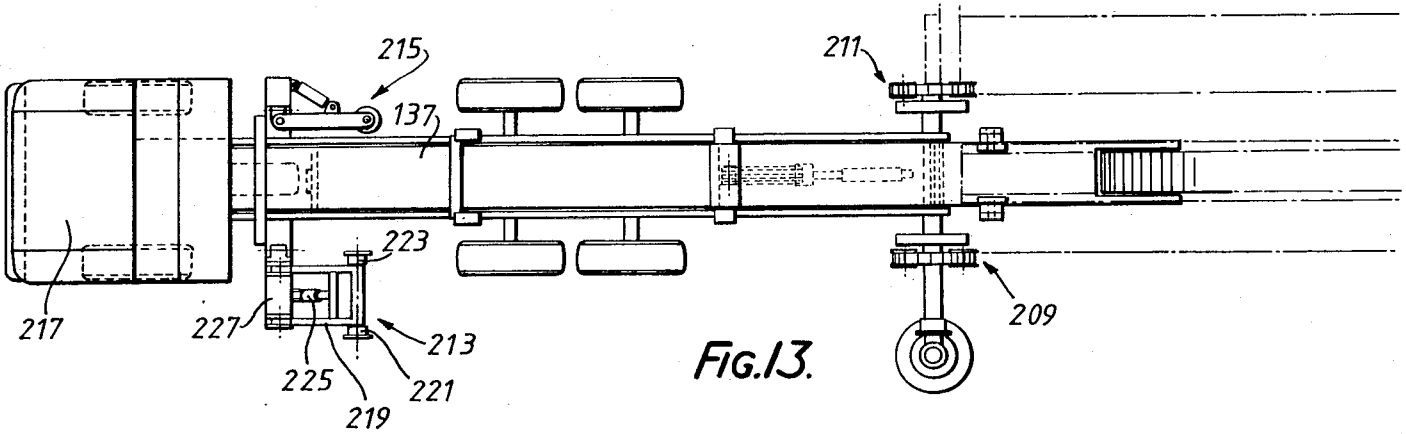
FIG. 13 is a plan view of a vehicle in accordance with the invention.
Figure 14:
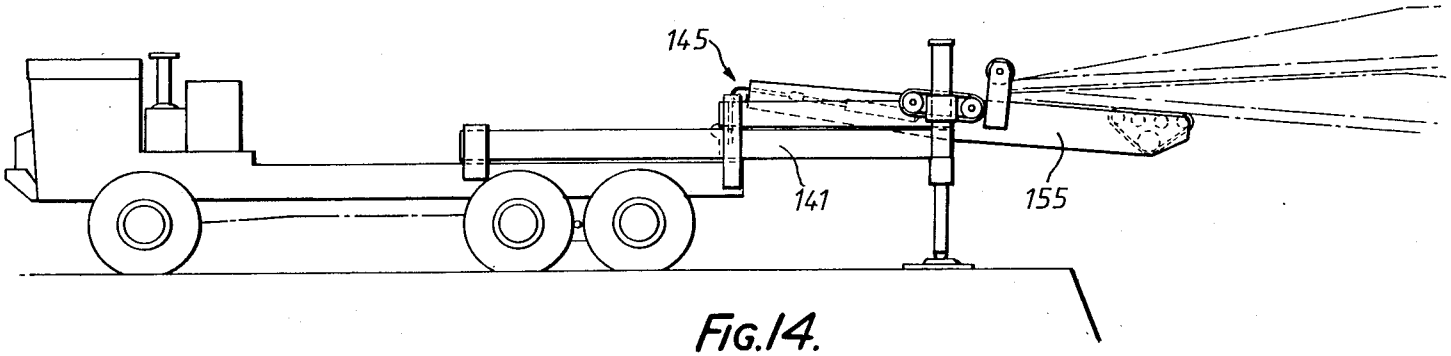
FIG. 14 is a schematic side elevational view showing a tiltable launching rail support on the frame.
Figure 15:
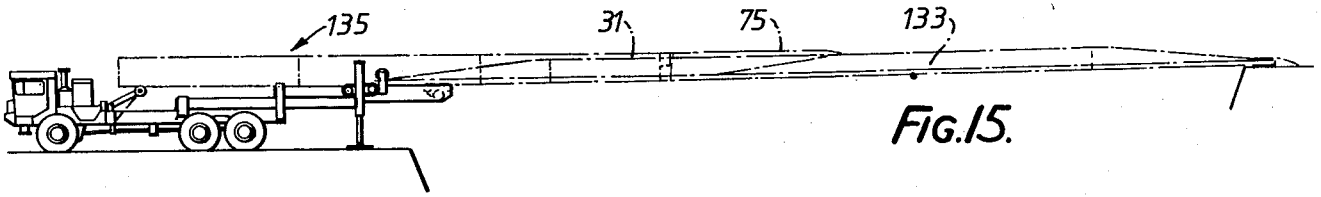
FIG. 15 schematically shows the launching of a bridge along the launching rail.

The remaining part of the bridge module support means is constituted by a pair of chassis outriggers 213 and 215. FIG. 13 shows the chassis outriggers 213 (which is deployed) and 215 (which is folded for transport) to be mounted towards the vehicular front of the chassis 137 behind the driver's cab 217. Each chassis outrigger 213 or 215 comprises a generally planar cradle 219, which is provided with an inwardly directed pair of flange rollers 221 and 223. When deployed, the cradle 219 is generally horizontal and the flanged rollers 221 and 213 are borne upon by a main girder structure of a bridge module. The cradle 219 can pivot about a horizontal axis parallel with the length of the vehicle 135 to stow neatly for transport. A piston and cylinder arrangement 225 mounted underneath the cradle and on an outrigger arm 227 to which it is attached enables the angle of inclination above the cradle 219 to the horizontal to be varied. Variations in bridge slope can therefore be accommodated.

A method of constructing a bridge in accordance with the invention will now be described. The bridge illustrated is to be built of a total of five bridge modules (three intermediate bridge modules 71 and two end bridge modules 75) and is capable of reaching a span of 100 feet (30.5 meters) (nominal). However, as some 95% of gaps in north-west Europe do not exceed 100 feet (30.5 meters), it is not foreseen that this will be a problem. Before construction proper can begin, all the components must be brought to the home bank. The components needed are as follows:

Launch vehicle;
Three intermediate launching rail modules;
Two end launching rail modules;
Three intermediate bridge modules;
Two end bridge modules;
Two end pads;
Two inter-trackway bracing frames; and
One hydraulic power pack.

The launching rail modules can be stowed on the launching vehicle for transport. All the remaining components, together with necessary slings etc., could be brought to the site on a total of three GS trucks which, in addition to a standard mobile crane would be all the vehicles needed for the bridge to be constructed. The crane would be expected to have a 3.5 tonne lift at a 6 meter outreach.

The hydraulic power pack, which is portable, is for articulating the end bridge modules 75 when jacking down the ends of the completed bridge.

The power pack can be powered by an air-cooled diesel engine of about 10 horsepower (7.5 kiloWatts) driving a variable displacement pump working at a pressure of 3000 psi (20.6 $MN/m^2$). The engine would be provided with hand or inertia start to obviate the need for batteries. Spare power units could be provided as a precaution against breakdown. In addition, an emergency hand pump could be provided to enable the bridge to be jacked down in the event of power failure. Recovery, however, would hardly be feasible with a manual pump, due to the height to which the bridge has to be jacked.

The launching vehicle 135 is first reversed up to the span to be crossed. The first sliding frame 141 is deployed and the frame outriggers 185 and 187, which function as jacks, are also deployed. The chassis outriggers 213 and 215 may also be deployed at this stage.

Using the crane (not shown) an end launching rail module 13 is placed on the launching rail support 155 and held there by the hold-down rollers 181. The toe of the end launching rail module 13 is so positioned that its toe is towards the far back. An end bearing pad 29 may be in position on the toe of the end launching rail module 13.

The crane now lifts an intermediate launching rail module 1 into position behind the end launching rail module 13. The end and intermediate launching rail modules 13 and 1 are coupled together. Because the intermediate launching rail modules only weigh 0.8 tonnes each, it is not necessary for the crane to be chocked at this stage.

The second sliding frame 145 is now deployed and the construction of the launching rail completed by joining on two further intermediate launching rail modules 1 and a final end launching rail module 13. As each intermediate launching rail module 13 is added, the launching rail is boomed out by means of the friction drive 169.

Before the last end launching rail module 13 is boomed out, the first tapered end bridge module 75 is lifted by the crane and unfolded. It is desirable for the crane to be chocked by means of outriggers and jacks before this stage because of the 3.5 tonne weight of the bridge modules. When the first end bridge module 75 has been placed on the launching rail, to which it is connected by means of a tension connection at position 83 (FIG. 5A), a first roller bracing frame 115 is fitted between the trackways of the end bridge module 75. The end bridge module 75 is articulated upwards (in the position shown by the discontinuous lines in FIG. 5A) so that the upper chord is approximately horizontal. In this way, the end bridge module 75 is appropriately aligned for connection to an intermediate bridge module 31. The hydraulic power pack is now lifted onto the bridge by the crane.

Figure 16:
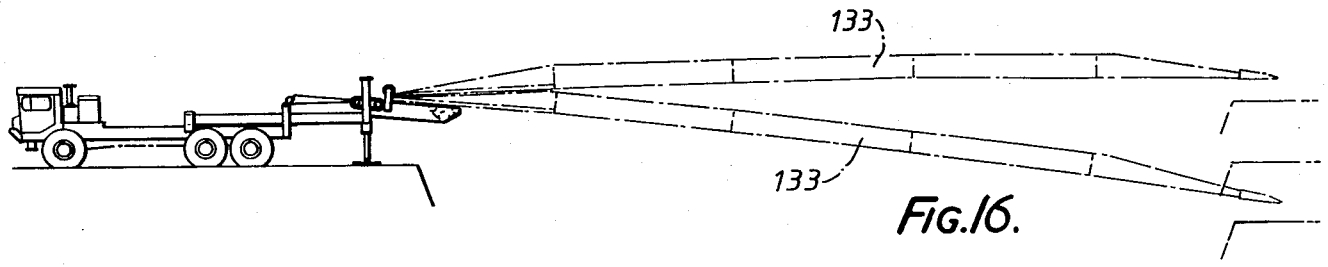
FIG. 16 shows how the launching rail may be landed on the far bank at a height differing from or the same as the home bank.
Figure 17:
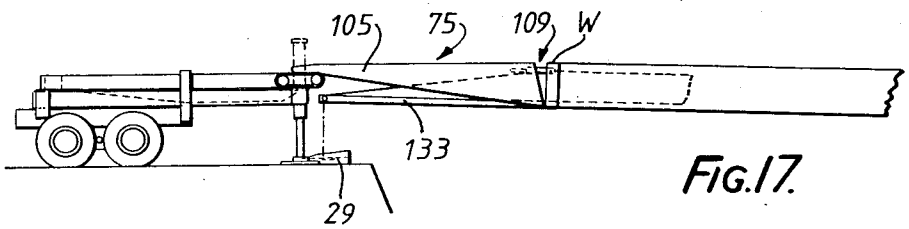
FIG. 17 shows a concluding stage of the construction of the bridge at the home bank.

The launching rail 133 is now landed on the far bank, as shown in FIG. 16. This is achieved by tilting the support 155 by actuating the hydraulic piston and cylinder arrangement 159. The extent of tilt of the support 155 will depend on the level of the far bank with respect to the home bank. The launching rail 133 now forms a simply supported beam across the span and along which the bridge can be launched. It should be noted that all the hydraulic requirements of the equipment of the launching vehicle can be satisfied by a hydraulic pump fitted to the vehicle engine power take-off.

Bridge construction proceeds by use of the crane. The connection or coupling between successive bridge modules 75 and 31 or 31 and 31 is made by connecting pins. The lower chord outer pins are placed by hand. The lever mechanism 101 used for sliding the lower chord inner pins into position obviates the necessity for a man to go underneath the bridge. The upper chord tension connections can be made by a man standing on the deck. Each time subsequent intermediate bridge modules 31 are added, the bridge is moved forward by a module's length by means of the bridge module friction drive unit 209 and 211. On coupling the second end bridge modules 75 at the end of the bridge, a second roller bracing frame 115 is fitted between the trackways of the second end bridge module 75.

When the bridge is complete, and the first bridge end module 75 is at the far bank, the first end bridge module 75 can be jacked down by means of the hydraulic power pack (not shown) which is on the bridge. The weight of the bridge will then be transmitted by means of the end bridge module, rather than the launching rail, to the far bank.

On the home bank, the hydraulic power pack is again used. The articulation of the second end bridge module 75 (which is at the home bank) is operated so that the ramp section 105 supports the weight of the bridge on the bridge support rollers 205 and 207 and the bridge module friction drive units 209 and 211, which are on the frame 139 of the vehicle 135. The launching rail 133 may then be connected to the second roller bracing frame 115 by a tension link W. The second sliding frame 145, which no longer supports the weight of the bridge through the launching rail 133, can then be retracted.

By articulating the ramp portion 105 of the second end bridge module 75, the launching rail 133 can be lowered down onto a second end bearing pad 29, which has been positioned to receive it. When all the home bank weight of the bridge has been transferred to the bearing pad 29, the ramp portion 105 of the second end bridge module 75 can be lifted clear of the vehicle, again by means of the hydraulic piston and cylinder arrangement 109 in the second end bridge module. The frame outrigger jacks can be raised and the first and second sliding frames 141 and 145 can be retracted clear of the bridge.

The chassis outriggers 213 and 215 can then be stowed and the vehicle 135 driven away. Meanwhile, the piston and cylinder arrangement 109 of the second end bridge module 75 can be used to jack down the home bank end of the bridge and if necessary, as with the far bank end, a deck compression unit 113 may be inserted.

The bridge is now complete and can be opened to traffic.

The launching rail remains in the bridge, ready for recovery, which can take place from either end, due to the symmetrical construction of the bridge.

It should be noted that if the launching rail is suspended from the tension connection marked W and from a corresponding one at the other end of the bridge, the lower connecting pins joining the end launching rail modules 13 to their respective neighbouring intermediate launching rail modules 1 can be removed. It is possible to reduce the end slope of the bridge, or even to have the deck level, by reducing the width of the deck compression units 113 shown in FIG. 5A.

It should be mentioned that, to achieve the various tension connections (as mentioned for point W) during construction of the bridge, each end launching rail module 13 and each intermediate launching rail module 1 is provided with a tension connection for connection to the centre decking of the bridge at the appropriate point.

The sequence for recovery and dismantling the bridge is essentially the reverse of the launching sequence. The timing may be comparable.

It can thus be seen that a bridge of MLC 70 capability can readily be built efficiently and rapidly. It is anticipated that a nominal 100 feet (30.5 meters) span could be bridged with the aid of a launching vehicle, a crane and six men in less than 15 minutes by night. The six men include the bridge commander and crane operator. The 4 meter wide deck presented by the bridge in use should be sufficient for conveying the majority of ground based military equipment across the span.

Finally, a word about dimensions and moments to illustrate the general compactness of the launching vehicle 135 and the stability of the bridge under construction. The maximum height of the launching vehicle 135 (see FIGS 1A and 1B) will be 10 feet (3 meters). The maximum width when all the outriggers are in the stowed position will be 10 feet 6 inches (3.2 meters), but this includes the width of the pads 193 on the frame outriggers 185 and 187. The width of the vehicle without the frame outriggers 185 and 187 is 8 feet 9 inches (2.7 meters). As for length, the vehicle with all outriggers stowed is 32 feet (9.75 meters) long from the front to the furthest rear extremity.

When the first sliding frame 141 is deployed, the length between the centres of the pads 193 and a mid line between the two rear axles of the launching vehicle is 16 feet 6 inches (5 meters). There is a further 17.7 feet (5.4 meters) between this midline and the front axle. Now the front axle weight of the vehicle is 7 tonnes and each of the rear axles transmits a weight of 7.5 tonnes.

Thus the total moment due to the vehicle about a fulcrum above the centres of the pads 193 is:

$$(5\ m+5.5\ m)\times 7\ t+5\ m\times(7.5\ t+7.5\ t)=142.8$$
meter-tonnes.

The launching rail 133 is composed of five modules, each of which weighs about 0.8 tonne, The total weight of the launching rail is therefore 4 tonnes. Because of the symmetrical nature of the 100 feet (30.5 meters) launching rail, this can be regarded as acting 50 feet (15.25 meters) from the centres of the pads 193, when the launching rail is fully boomed out, to give a clockwise moment of 61 meter-tonnes, which is comfortably less than the 142.8 meter-tonnes anti-clockwise moment due to the vehicle 135. Stability during construction is therefore assured. It can be seen that the pads 193 should be capable of transmitting a load of at least the total weight of the launching rail and the launching vehicle 135. In practice, they should therefore be able to support a load of about 26 tonnes.

What I claim is:

1. A method of constructing a modular bridge across a span having a home bank and a far bank, the method comprising:

(a) providing a plurality of bridge modules, each bridge module comprising two longitudinal main girder structures and an intermediate deck having a deck surface capable of supporting vehicles, the intermediate deck extending substantially the entire length of the bridge modules, foldable connecting means foldably connecting the main girder structures to each side of the central deck in a manner such that the main girders are foldable between an operative position in which the main girder structures offer extensions of the deck surface on either side of the deck for use and a close position in which the main girder structures are folded beneath the deck;

(b) providing a launching vehicle on the home bank of the span, the vehicle having bridge modular support means for supporting a module of a modular bridge;

(c) deploying a frame over the launching vehicle, the frame having a support for a bridge launching rail;

(d) placing a first bridge launching rail module on the support to thereby start forming a launching rail;

(e) booming out the launching rail as it is formed, (f) placing at least one subsequent launching rail module as the launching rail support and coupling at least one launching rail module to the launching rail being formed;

(g) landing the far end of the launching rail on the far bank of the span;

(h) placing a first bridge module on the launching rail and in the bridge module support means of the vehicle, to thereby start forming a bridge;

(i) launching the bridge module along the launching rail as the bridge is formed, and (j) placing at least one subsequent bridge module on the launching rail and on the bridge module support means and coupling at least one subsequent bridge module to the bridge being formed.

2. A method as claimed in claim 1, wherein the bridge comprises two end modules in each of which the main girder structures are longitudinally tapered in depth when seen from a side of the module and at least one intermediate module in which the main girder structures are not so tapered.

3. A method as claimed in claim 1, in which the main girder structures are box girder structures.

4. A method as claimed in claim 1, wherein each main girder structure comprises at least one first lifting attachment on a surface offering the extension of the deck surface.

5. A method as claimed in claim 4, wherein each of the first lifting attachments is recessed.

6. A method as claimed in claim 1, wherein each main girder structure comprises at least one second lifting attachment on a surface which is facing a corresponding surface of the other main girder structure when the module is in the operative position.

7. A method as claimed in claim 1, wherein the deck comprises two lip portions and wherein each of the main girder structures comprises a shoulder portion, each of which lip portions bears on a respective one of the shoulder portions when the module is in the operative position.

8. A method as claimed in claim 1, wherein the module further comprises a bracing means between the main girder structures for bracing the module when in the operative position.

9. A method as claimed in claim 1, the method comprising providing means for altering the angle of approach offered by an end bridge module.

10. A method as claimed in claim 9, wherein the altering means comprises one or more hydraulic piston and cylinder arrangements for articulating the end bridge module.

11. A method as claimed in claim 9, wherein a deck extension unit is provided for inserting in the end bridge module at a given angle of approach.

12. A method as claimed in claim 11, wherein each sub-frame has a pair of rollers, one for bearing on each of a pair of flanges on the launching rail.

13. A method as claimed in claim 1, wherein one or more sub-frames are provided for bracing the bridge and for supporting the bridge on the launching rail.

14. A method as claimed in claim 13, wherein one sub-frame is provided towards each end of the bridge.

15. A method as claimed in claim 1, in which successive bridge modules are connected by inserting a pin through two lugs, one on each bridge module.

16. A method as claimed in claim 15, wherein the pin is inserted remotely by means of a lever.

17. A method as claimed in claim 16, wherein the lever is a bell-crank lever.

18. A method as claimed in claim 1, wherein the launching rail is of inverted-T shaped configuration.

* * * * *